US007430770B2

(12) United States Patent
Ramirez

(10) Patent No.: US 7,430,770 B2
(45) Date of Patent: Oct. 7, 2008

(54) ENCLOSURE ASSEMBLY FOR A SAFE ZONE SURROUNDING A MATTRESS

(76) Inventor: Elizabeth Ramirez, 2938 NW. 39 Pl., Gainsville, FL (US) 32605

( * ) Notice: Subject to any disclaimer, the term of this patent is extended or adjusted under 35 U.S.C. 154(b) by 254 days.

(21) Appl. No.: 11/324,179

(22) Filed: Dec. 30, 2005

(65) Prior Publication Data

US 2006/0168722 A1 Aug. 3, 2006

Related U.S. Application Data

(63) Continuation-in-part of application No. 10/816,483, filed on Mar. 30, 2004, now abandoned.

(60) Provisional application No. 60/459,484, filed on Apr. 1, 2003.

(51) Int. Cl.
*A61G 7/05* (2006.01)
*A47C 21/08* (2006.01)
*A47C 29/00* (2006.01)

(52) U.S. Cl. ..... 5/424; 5/97; 5/414

(58) Field of Classification Search ..... 5/424, 5/93.1, 94, 98.1, 97, 414, 2.1, 662, 658; 135/96
See application file for complete search history.

(56) References Cited

U.S. PATENT DOCUMENTS

| | | | | |
|---|---|---|---|---|
| 3,399,670 | A | 9/1968 | Veasey | |
| 3,695,698 | A | 10/1972 | Trump | |
| 4,141,093 | A | 2/1979 | Marsden | |
| 4,357,722 | A | 11/1982 | Thompson | |
| 4,630,324 | A | 12/1986 | Fligsten et al. | |
| 4,641,387 | A | 2/1987 | Bondy et al. | |
| 4,742,821 | A | 5/1988 | Wootan | |
| 5,375,879 | A | 12/1994 | Williams et al. | |
| 5,384,925 | A | 1/1995 | Vail | |
| 5,536,042 | A | 7/1996 | Williams et al. | |
| 6,067,676 | A | 5/2000 | Carnahan et al. | |
| 6,216,291 | B1 | 4/2001 | Eads et al. | |
| 6,487,735 | B1 * | 12/2002 | Jacques et al. | 5/424 |
| 6,550,083 | B1 | 4/2003 | LaMantia | |
| 6,772,458 | B2 | 8/2004 | Ellen et al. | |
| 7,047,991 | B2 * | 5/2006 | Kline | 135/96 |
| 2005/0235418 | A1 * | 10/2005 | Jacques et al. | 5/424 |

* cited by examiner

*Primary Examiner*—Alexander Grosz
(74) *Attorney, Agent, or Firm*—Malloy & Malloy, P.A.

(57) ABSTRACT

A enclosure assembly with a support for a mattress of a bed to accommodate a person on the mattress, the enclosure assembly including a framework having connectors to secure the framework in an upstanding relation peripherally about the mattress, the framework including corner posts each extending a generally common distance above the mattress, and frame members spanning the corner posts. A net having inside and outside surfaces is supported on the framework and has at least one normally closed opening provided with a closure member which may only be opened from the outside of the net, thereby at least partially defining a "safe zone" about the periphery of the mattress. The enclosure assembly also comprises a coverlet which overlies the mattress and is removably interconnected along its periphery to the inside surface of the net, thereby further defining the "safe zone" about the mattress on which the person may rest without risk of falling off the mattress and harming themselves.

20 Claims, 7 Drawing Sheets

ENCLOSURE ASSEMBLY FOR A SAFE ZONE SURROUNDING A MATTRESS

CLAIM OF PRIORITY

The present patent application is a Continuation-In-Part of previously filed U.S. patent application filed on Mar. 30, 2004 and having Ser. No. 10/816,483, now abandoned, which was based upon and properly claimed priority to then U.S. Provisional Patent Application having Ser. No. 60/459,484 which was filed on Apr. 1, 2003, and the present invention was the subject of Disclosure Document No. 495,830, dated Jun. 5, 2001, each of which are incorporated herein by reference in their entirety.

BACKGROUND OF THE INVENTION

1. Field of the Invention

This invention is directed to an enclosure assembly disposed about a bed and relates, specifically, to an enclosure assembly structured to create a "safe zone" around a mattress of the bed. The enclosure assembly may be used with either a conventional bed or a more elaborate hospital bed, wherein the bed has a fixed or movable support for a mattress on which a person may rest, or, as in the illustrative embodiment of FIG. 1, the enclosure assembly may stand alone and include supports for the mattress thereon.

The enclosure assembly of the present invention is adjustable to accommodate a range of different size beds and/or mattresses. It may include supports upon which a mattress may be supported when assembled. More particularly, the enclosure assembly of the present invention includes, in general, a) a framework which attaches to or includes a mattress support, b) a shroud of sturdy mesh or open net material covering, surrounding or enshrouding the framework about the periphery of the mattress, and, c) a coverlet structured to overlie the mattress and to removably interconnect about its periphery to the inside surfaces of the shroud. The enclosure assembly permits substantially unrestricted movement to a bedridden patient within the "safe zone" which is defined by the enclosure assembly about the periphery of the mattress, while safely limiting or confining the patient's movements to only that space above the mattress and enclosed by the "safe zone."

2. Description of the Related Art

Generally, the present invention is directed to an enclosure assembly structured to define a confining "safe zone" about the periphery of a mattress of a bed such that maximum freedom of movement, albeit limited movement, may be enjoyed by the patient on the mattress within the "safe zone," for those situations where the person is a patient who requires such limitations of movement for medical reasons.

In general, the enclosure assembly comprises: a) a framework of interconnected mating components to be assembled and which may be removably secured either to the mattress support of a bed or includes a mattress support; b) a shroud of sturdy mesh or open net material covering, surrounding or enshrouding the framework about the periphery of the mattress; and, c) a coverlet structured to overlie the mattress and to removably interconnect about its periphery to the inside surfaces of the shroud. In use, the framework of the enclosure assembly is either attached to a support structure for the mattress of a bed or the framework includes a support for a mattress such that it comprises a stand alone enclosure assembly. In either case, a shroud surrounds the framework thereby enclosing the mattress at least around its periphery. An opening is provided to administer to the patient as required, or as desired, however, the opening is normally closed by a suitable fastener means or closure means which is only operable to open and close the opening from outside the "safe zone" of the enclosure assembly.

In the past, there has been a need to confine some persons on a mattress of a bed for various reasons. Some are frail and cannot get out of bed while they do have enough energy to roll off it. Others are strong enough to get out of bed partway but are so weak they are apt to fall while actually in the act of getting out of the bed. Yet others are very weak and, hence, likely to fall immediately or shortly after arising if not attended by another, such as a nurse. Indeed, some are children in pediatric wards, which include hyperactive children. Still others are confined for psychiatric maladies. Importantly, there are a growing number of elderly patients who are literally in bed for the remainder of their lives, some are in hospices, while others are in private facilities or in a home environment. Whatever the location and reason, as much freedom of movement as is possible for a bedridden person is beneficial for most of them to the extent possible and tolerable, if not all of them. In short, movement, albeit limited, is good, both physically and psychologically. The present invention permits a bedridden patient to enjoy substantially unrestricted movement while on a mattress of a bed which is only limited or confined by the "safe zone" defined by the enclosure assembly. The present invention, nevertheless, helps the patient to avoid the feeling of being greatly restrained and locked in a cage, because the surrounding mesh network is an open mesh material through which air may freely circulate and which does not unduly limit vision or communication with persons on the outside of the enclosure assembly.

To keep persons from falling from bed, some patients have in the past simply been tethered, which is known to be dangerous, witness the plight of a dog entangled in a chain. Other patients are placed on a mattress on the floor, so, if a fall does take place, it is only for a very short distance. But sleeping on the floor, where there are bugs and whatnot, is, of course, primitive and is not tolerated by most civilized persons, whether of not they are disabled. That is the main reason why, almost universally, beds provide a somewhat elevated, generally horizontal, mattress support.

To avoid the problem of patient falls from an elevated mattress of a bed, bed rails are sometimes used. These have proven to be dangerous because the limbs of some such patients often become trapped between the mattress and the bed rail, or, indeed in the bed rail itself. This can cause serious injury and even death. Moreover, some patients, while physically able to climb up onto the bed rails in an effort to get over them, are not able to complete the process of getting out of bed safely. This often results in such a person finding that the reward for effort expended is a very precarious perch preceding a serious or deathly fall. Therefore, such unfortunate individuals sometimes balance, as best they can, on the bed rails and hold-on for dear life dangerously exhausting themselves, while other just give up and fall injuring themselves. It is not uncommon, therefore, to strap patients in bed or use other restraints which are quite inhumane in an effort to avoid falls and consequent injuries. With such measures there are many well known problems such as: problems of reduced circulation, muscle atrophy, decubitus ulcers, anxiety, feelings of helplessness, injuries from attempts to escape, interference with medical appliances for administering to the patient, hernias, respiratory ills, etc. In the face of all the above, patients who should not, still do try to get out of bed, to escape its confines, sometimes in an effort just to go to the bathroom in private, or for some other relatively innocent reason.

As such, it would be beneficial to provide an enclosure assembly having a framework disposed about the periphery of a mattress of a bed which is structured to support a shroud so as to at least partially define a "safe zone" around the periphery of the mattress in which a patient may enjoy relatively unrestricted freedom of movement. It would also be helpful for the shroud of any such enclosure assembly to comprise an open mesh material through which air may freely circulate and which does not unduly limit vision or communication with persons the outside of the enclosure assembly. Another advantage may be realized if the open mesh network is constructed of a white or other light color material such that it will be readily apparent to a caregiver if the mesh material becomes soiled by the patient, or otherwise. In addition, it would be preferable for such an enclosure to include a coverlet structured to overlie the mattress and to removably interconnect about its periphery to the inside of the shroud so as to further define the "safe zone" in which the patient in maintained.

SUMMARY OF THE INVENTION

This invention addresses a serious and most dangerous problem which all too often results in needless serious fall injuries. The seriousness of this problem has been discussed at various committee meetings of the U.S. Senate and the House, as well as by corresponding legislative bodies of many of the various states, and other governmental administrative agencies as has been described in numerous associated articles and various study reports.

Generally, the invention provides an improved enclosure assembly that defines a "safe zone" around and above a mattress of a bed and its support, within which substantially unrestricted freedom of movement may be enjoyed by the patient in the "safe zone" on the mattress. The "safe zone" above the mattress is at least about three feet in height above the mattress and extends substantially around the periphery of the mattress, in at least one embodiment. It is most useful for those special situations where a patient is elderly and/or frail.

In general, the patient confining structure comprises: a) a framework of interconnected mating components to attach to or provide a support for a mattress; b) a shroud of sturdy mesh or open net material covering, surrounding or enshrouding the framework about the periphery of the mattress; and, c) a coverlet structured to overlie the mattress and to removably interconnect about its periphery to the inside surfaces of the shroud. The shroud is provided with at least one main opening with a gate means to administer to the patient as required, or as desired. In at least one embodiment, the one or more gate means have a suitable fastener means, closure means or locking means which is operable to open and close the gate of the opening, but only from outside of the "safe zone" of the enclosure assembly. Thus, the present invention confines movement of the patient to the surface of the mattress which is substantially surrounded about its periphery by the shroud, however, it will be appreciated that this allows the patient to enjoy substantially unrestricted movement within the "safe zone," as discussed in greater detail hereinafter.

In summary, this invention has an adjustable framework which, preferably, can be sized to fit different size mattresses and beds in the ranges most often encountered. In use, the framework may be attached to a mattress support of a bed, or it may include a mattress support and be structured to stand alone. In either case, a shroud is attached to the framework, which enshrouds or surrounds the periphery of the mattress and at least partially defines a "safe zone" on and above the mattress surface and which, in use, limits the movement of a person who requires that to the "safe zone." Additionally, the present invention provides access to the patient by one from outside the enclosure assembly, but prevents egress by the person in the enclosure assembly without assistance by one from outside of it.

These and other objects, features and advantages of the present invention will become more clear when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
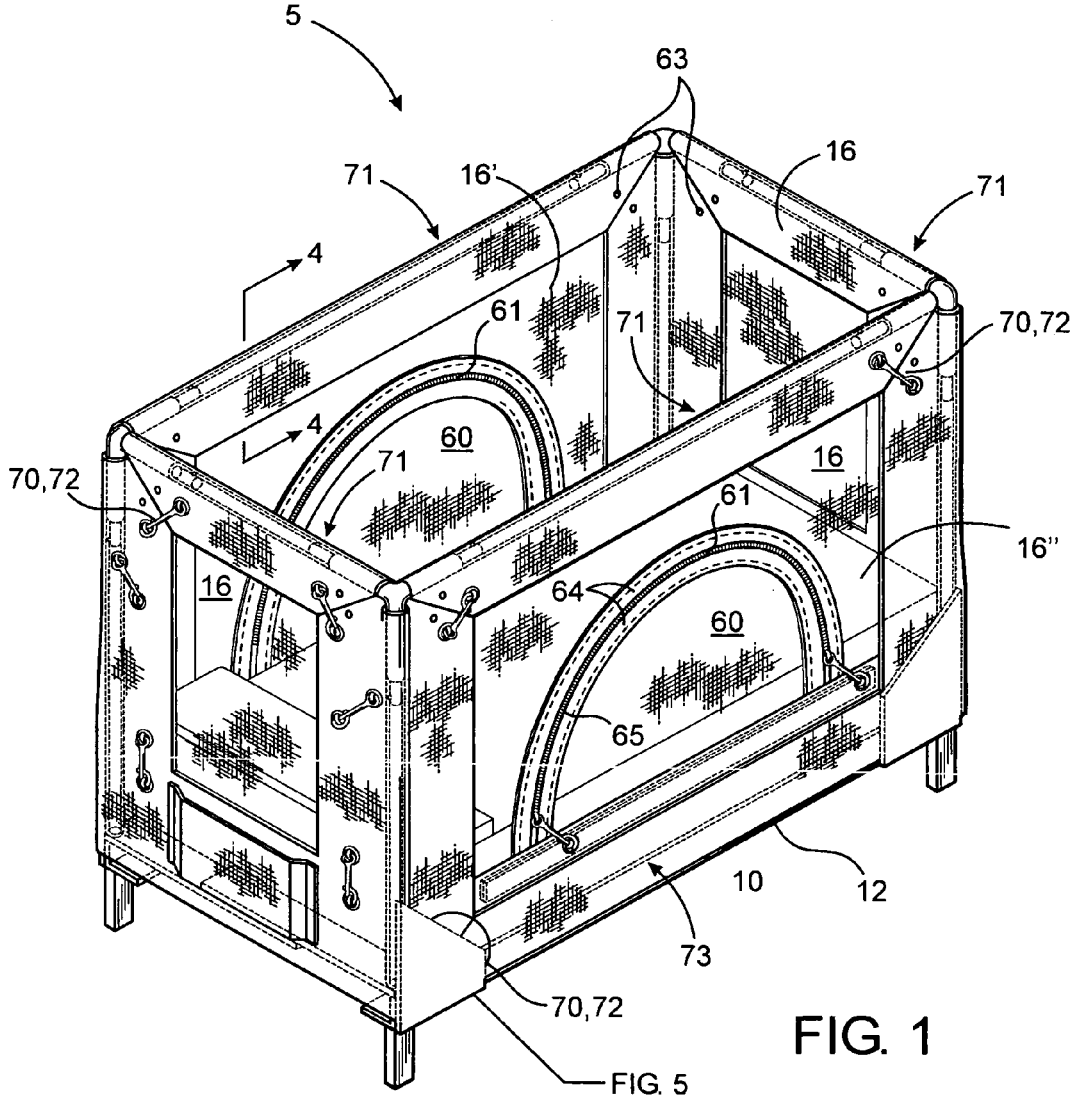
FIG. 1 is a perspective view of one embodiment of an enclosure assembly in accordance with the present invention.

In general, the present invention is directed to an enclosure assembly 5 which is mounted to a bed or comprises a stand alone assembly. In one embodiment, the present invention provides a means of support for a mattress 10 to accommodate a person at rest on the mattress 10, and comprises a framework 14 disposed in an upstanding relation peripherally about the supported mattress 10. The framework 14 includes corner posts 17, 18, 20, and 22, each extending a generally common distance above the mattress 10, and, the framework 14 further includes elongated spanning members 28, 30, 32, and 34 interconnected to and spanning the upper ends of the corner posts 17, 18, 20, and 22, generally defining a "safe zone" 15 between the corner posts 17, 18, 20, and 22, and the spanning members 28, 30, 32, and 34, above the supported mattress 10.

Additionally, this "safe zone" 15 is enclosed about a periphery of the mattress 10, as illustrated in the figures. To this end, the present invention also includes a shroud 16 having an inside surface 16' and an outside surface 16", and being supported on the framework 14 and surrounding, if not enshrouding, the "safe zone" 15. Additionally, the present invention provides suitable means to interconnect the shroud 16 and the framework 14 with one another. The shroud 16 has at least one main or access opening 60 comprising a normally closed gate or closure means secured on the shroud 16, such as, a zipper 65 with an operator lever, or hook and eye fasteners, structured to allow opening and closing of the access opening 60 only from the outside surface 16" of the shroud 16, and to prevent opening and closing of the access opening 60 from the inside surface 16', i.e., from within the "safe zone" 15 of the enclosure assembly 5. In the illustrative embodiment of FIG. 1, it is seen that the shroud 16 comprises a plurality of access openings 60, disposed on opposite sides of the shroud 16, to further facilitate access to the "safe zone" 15 as may be required to attend to a patient therein.

Figure 2:
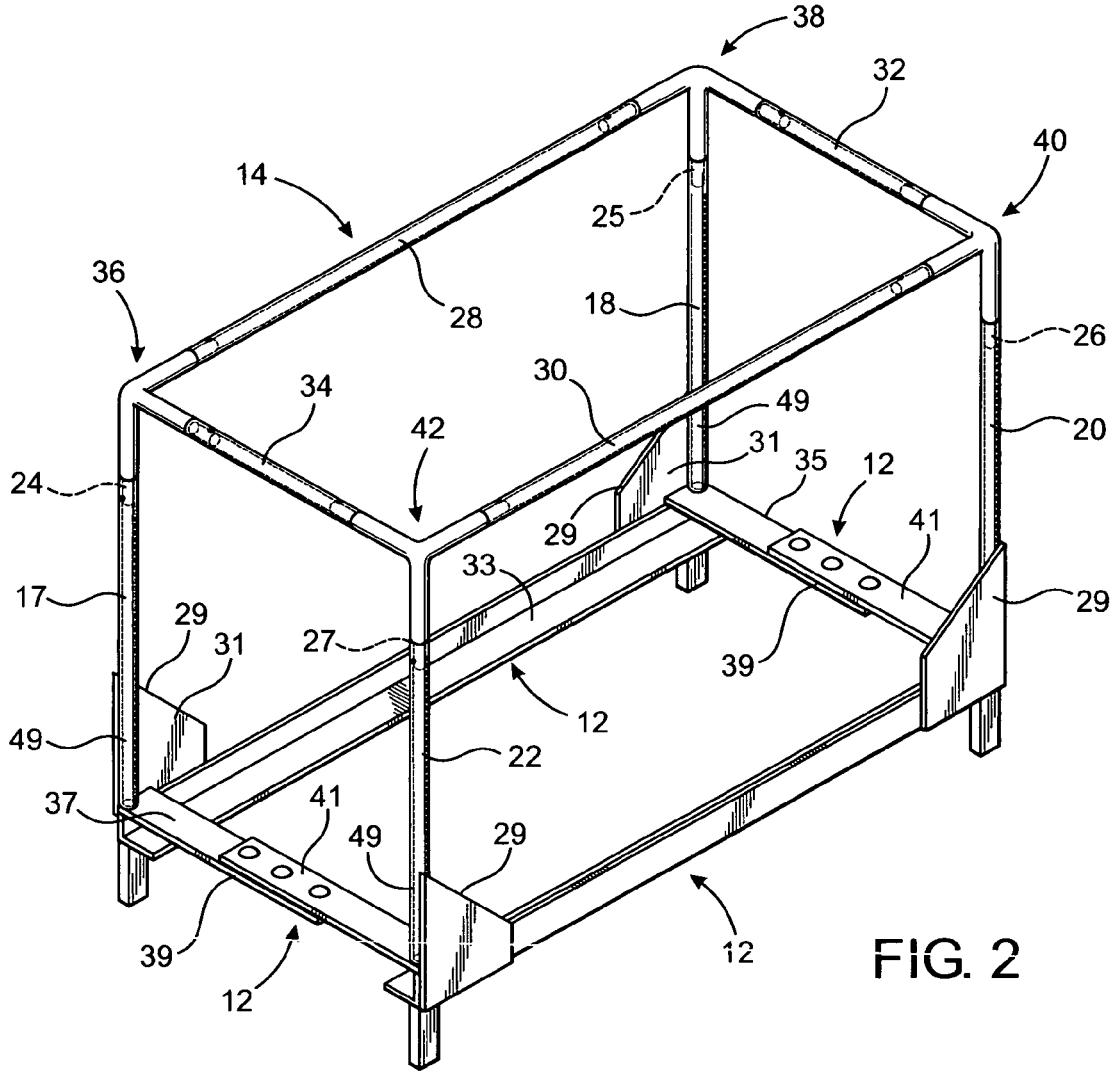
FIG. 2 is a perspective view of a framework of the enclosure assembly of FIG. 1 illustrating a mattress support.
Figure 5:
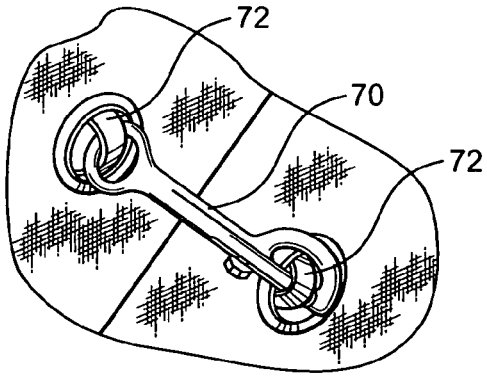
FIG. 5 is a partial view of that portion indicated by the legend "FIG. 5" at the lower right of FIG. 1.
Figure 4:
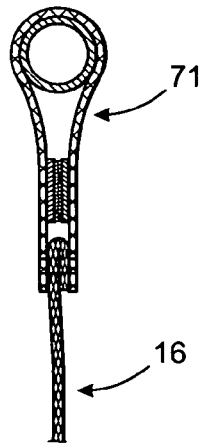
FIG. 4 is a partial view of that portion of FIG. 1 indicated at the upper left of FIG. 1 and taken on the plane indicated by lines 4-4.
Figure 3:
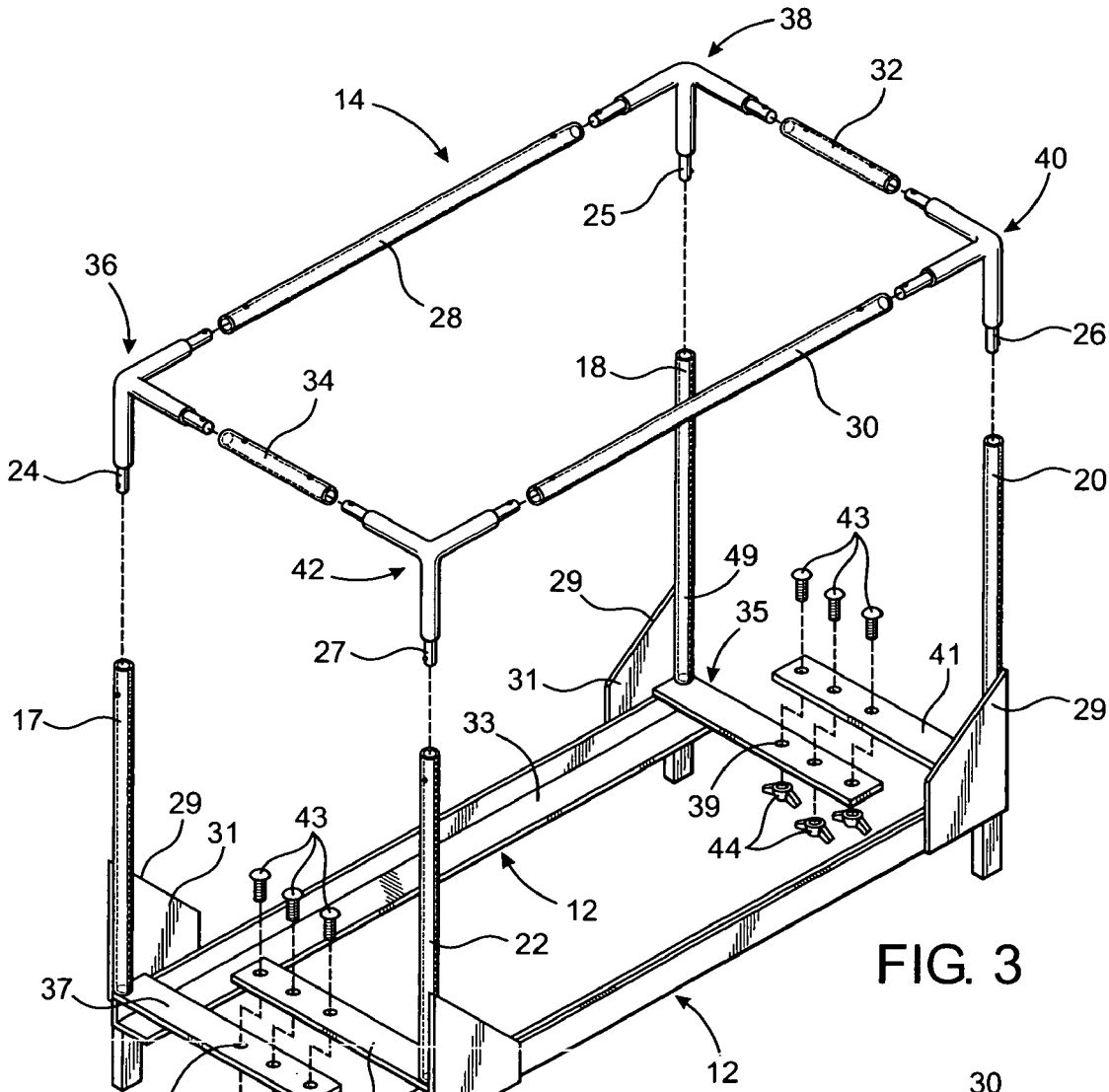
FIG. 3 is a partially exploded perspective view of the framework of FIG. 2.

At least one embodiment of the present invention includes a connector between the corner posts 17, 18, 20, and 22 and spanning members 28, 30, 32, and 34, the connectors being shown at 36, 38, 40, and 42 in FIGS. 2 and 3. The framework 14 includes support legs of a length as preferred or required to stand alone supporting a mattress 10, the lower ends of which may be provided with wheels, as is often found on institutional equipment or, indeed, in the home or a caretaker place. The framework 14 may also include at least a partial floor or floor means to support the mattress 10.

Figure 10:
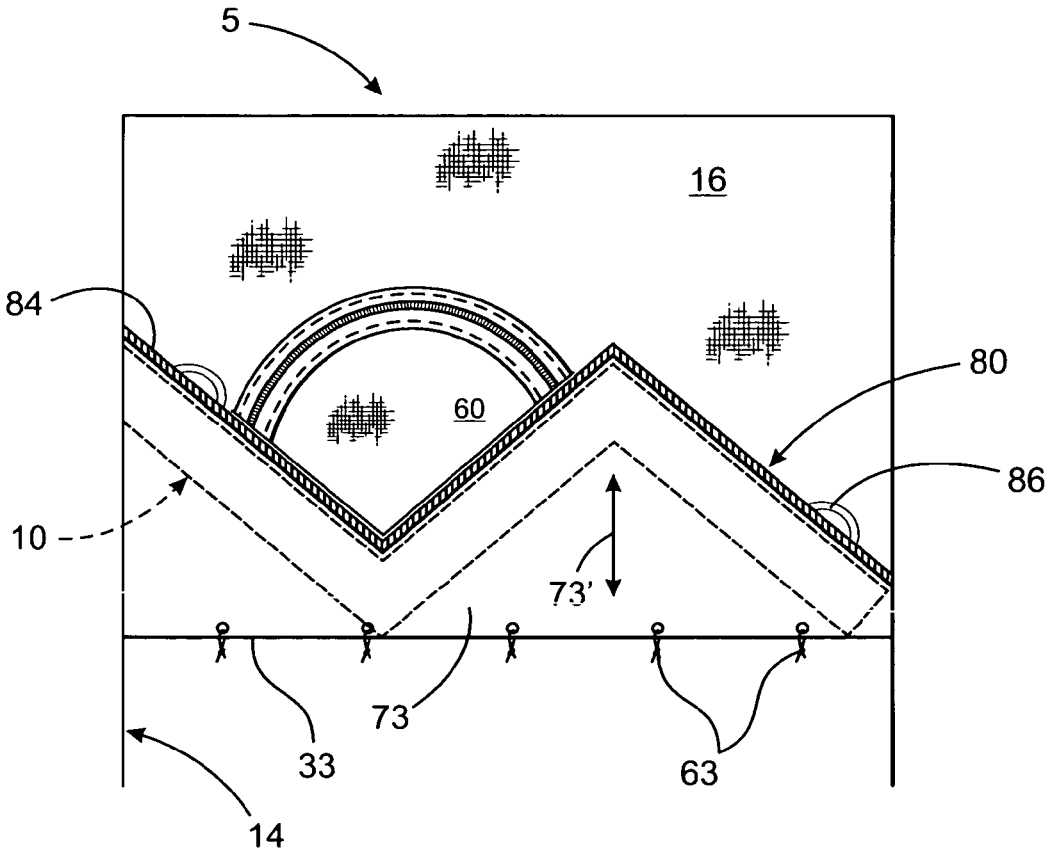
FIG. 10 is a side elevation of another embodiment of the present invention illustrating a mattress and a coverlet disposed in an elevated configuration.

Referring now to FIGS. 1 and 2, there is an illustration of the mattress 10, which may be in a washable casing, on a mattress support 12 of the framework 14 of the invention. The invention includes a shroud 16 comprising a sturdy mesh or open net material, which, when interconnected to the framework 14, enshrouds and substantially surrounds the periphery of framework 14, and thus, substantially surrounds a periphery around the mattress 10, whether it is supported on a bed on which the enclosure assembly 5 has been mounted or whether the enclosure assembly 5 stands alone. The mattress support 12 may be of a conventional construction which has legs and accordingly is elevated, or, indeed, it may be quite low compared to the conventional bed height. Its dimensions and configuration as well as its height may even be adjustable to permit raising or lowering portions of the mattress 10, as illustrated in FIG. 10. For example, either the foot zone or the head zone or, for that matter, both zones, may be raised or lowered as may be required for the health and comfort of the patient.

The framework 14, as noted above, includes upstanding corner posts 17, 18, 20, and 22 adjacent each corner of the mattress 10 and mattress support 12. Each of these upstanding corner posts 17, 18, 20, and 22 is preferably of a common length and has an upper end zone and a lower end zone, respectively. In at least one embodiment, the upper end zones 24, 25, 26, and 27, are generally disposed approximately three feet above an upper surface of the mattress 10. These upper end zones 24, 25, 26, and 27 are spanned by a first pair of side members 28 and 30 having a common length, and a second pair of end members 32 and 34 having a shorter common length.

Figure 6:
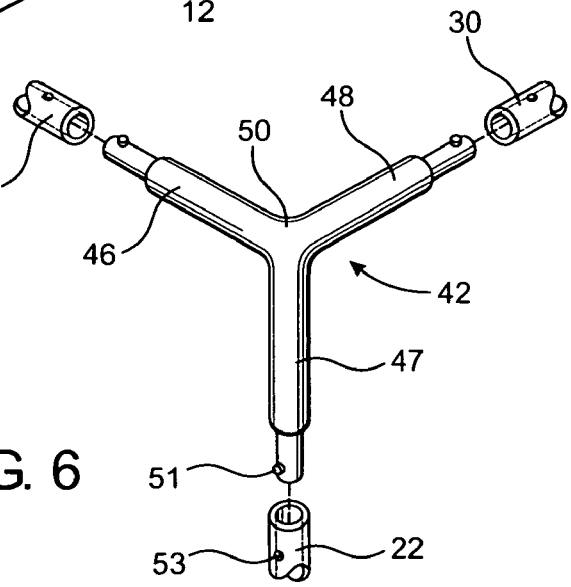
FIG. 6 is a partial perspective view of a connector means seen at the top corners of the enclosure assembly as illustrated in the partially exploded view of FIG. 3.

The adjacent upper end zones of the corner posts 17, 18, 20 and 22 and of the elongate spanning members 28, 30, 32 and 34 are interconnected by connectors 36, 38, 40, and 42, as shown in FIGS. 2, and 3. Referring to FIG. 6, and specifically, to connector 42, we see that the connector 42 includes interconnected tubular portions, such as 46, 47, and 48. The bores of the upper ends of the corner posts 17, 18, 20, and 22 are of a common cross sectional shape and size to mate with the portions 47 of the corresponding connectors. More particularly, each connector 36, 38, 40, and 42 is configured with a pair of right angularly coplanar tubular portions 46 and 48 and a portion 47 which is perpendicular to the common plane at the juncture 50 of the coplanar portions. Therefore, in assembly, the framework 14 is formed when the ends of each of the elongated spanning members 28, 30, 32 and 34 and of the upstanding corner posts 17, 18, 20, and 22 are mated by the corresponding connectors 36, 38, 40, and 42.

Preferably, the lower end zone 49 of each of the upstanding corner posts 17, 18, 20, and 22 is provided with a gusset plate 29 or brace having an inner surface 31 which confronts one of the outer side surfaces of the mattress 10. The mattress support 12 includes a partial mattress support surface, or partial floor means 33. Lateral interconnecting members 35 and 37, one at the head of the bed and one at the foot of the bed, are also provided. If desired, in order to provide for adjustability, each of the interconnecting members 35 and 37 may comprise a pair of overlapping members 39 and 41 having ends which adjustably overlap. These overlapping members may be secured together by bolts and wing nuts 43 and 44, respectively.

In the case where the enclosure assembly 5 is to be mounted onto a bed having a mattress support, the partial floor 33 of the enclosure assembly 5 is positioned on the bed's mattress support and tied to it by any suitable means to maintain it in a generally congruent position with respect to the mattress and its support. The means to tie may be of any suitable materials, for example wire or strips of cloth material may be used in a most simple form. Lateral planks, or members, each with a pattern of holes for receiving bolts are common expedients used in the field. These locations of mating bolts and various hole patterns correspond to patterns in existing hospital bedframe styles.

The various members of framework 14 may be extendable along their respective lengths which constitutes adjustment means to accommodate different size beds, and/or to adjust the height of the "safe zone" 15 above the surface of a mattress 10. In one preferred embodiment, the members of the framework 14 comprise two portions which telescope with respect to one another slidingly. To this end, bolts may be passed through slots which permit this type of adjustment of the overall length of a corresponding member, sometimes referred to a pin and slot connection.

The shroud 16, whether a sturdy mesh or open net material, is sized to fit closely about the periphery of the framework 14. In at least one embodiment, the shroud 16 may be in the form of a hood having a roof portion and a skirt along the sides, or it may constitute a fence like portion, or, in at least one alternative embodiment, the shroud 16 may be primarily supported about the corner posts 17, 18, 20 and 22, and elongated members 28, 30, 32, and 34. In either construction, the shroud 16 comprises a "see-through" material being of crisscrossed and spaced configuration such as, by way of example only, twisted thread bundles of strands of extruded plastic filaments, such as nylon filaments or other suitable material. In one preferred embodiment, the shroud 16 comprises a material which is white, or at least a light color, such that it will be readily apparent to a caregiver in the event the shroud 16 becomes soiled, such as from food, drink, or bodily fluids of the patient. Thus, the present invention inherently assists the caregiver in maintaining the "safe zone" 15 in a clean and sanitary condition, by providing a visual indication when it requires attention.

Figure 9:
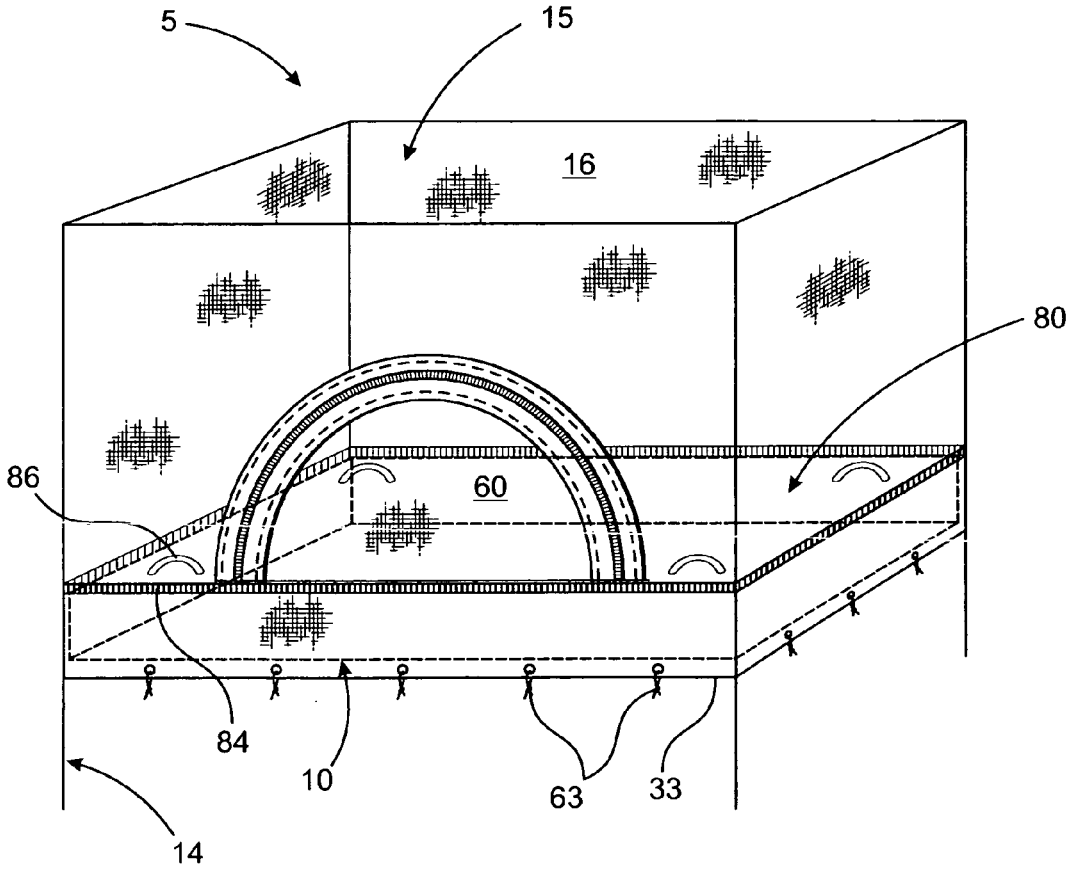
FIG. 9 is a perspective view of one embodiment of the present invention illustrating a coverlet on a mattress disposed in a normal horizontal configuration.

Uppermost peripheral portions of the shroud 16 are preferably reinforced as by a webbing strip 71, which may in at least one embodiment be of nylon, and which has proven to be very strong, for example, such as is used in parachute margin portions or seatbelts. Similarly, the lower periphery or lower skirt 73 of the shroud 16 is interconnected to the framework 14 about or adjacent to the partial floor means 33 by ties, laces, or any other suitable means so that it cannot be lifted or breached from within the "safe zone" 15 when in use. Eyelets 63 may be provided in the shroud 16 to accommodate laces or ties for fastening the lower periphery or skirt 73 of the shroud 16 to the framework 14, as best seen in FIG. 9. These eyelets 63 may also be disposed along the upper periphery of the shroud 16 thereby providing access for tubes to feed a patient or for administering medicines through catheters. In at least one embodiment, the eyelets 63 comprise grommets to prevent ripping or tearing of the material of the shroud 16.

The present invention further comprises a coverlet, generally as shown at 80 throughout the figures. The coverlet 80 is structured and disposed to overlie the mattress 10 to protect the mattress 10 from being soiled by food, beverages, medications, bodily fluids, etc, from a patient disposed thereupon. As such, the coverlet 80 is preferably sized with a periphery structured to substantially correspond to an outer periphery of an underlying mattress 10. Further, the coverlet 80 in one preferred embodiment comprises a machine washable fabric that will maintain its integrity after numerous machine washing and drying cycles. This embodiment assures ease of maintenance and, the use of machine washable fabric assures the coverlet 80 will be manufactured in a cost efficient manner. A standard pillow, cover, and/or blanket may be utilized and disposed overtop of the coverlet 80, however, one or more of these items may need to be moved to temporarily expose at least a portion of the coverlet 80 from time to time, as explained further below.

In the illustrative embodiments of FIGS. 7 through 10, the coverlet 80 comprises an attachment member 82 disposed substantially around a periphery thereof. In addition, in this illustrative embodiment, the shroud 16 also includes a corresponding attachment member 82' disposed substantially around a periphery thereof along the inside surface 16'. In a preferred embodiment, the attachment members 82 and 82' are structured and disposed to cooperatively engage one another so as to create a substantially continuous seam or seal 84 between the coverlet 80 and the periphery of the shroud 16 along an inside surface 16' thereof, thereby further defining a "safe zone" 15 within the enclosure assembly 5 of the present invention. More in particular, the seal 84 is structured to prevent a person within the "safe zone" 15 from reaching an arm or leg between the mattress 10 and the shroud 16 and possibly accessing the zipper 65 or other closure mechanism to allow them to exit the enclosure 5, or otherwise harm themselves in the process. In at least one embodiment, the seal 84 is further structured to minimize the transfer of liquids or fluids across the seal 84 from inside the "safe zone" 15 to the mattress 10, thereby facilitating the maintenance of mattress 10 in a clean and sanitary condition.

It will be appreciated that any one of a number of closure mechanisms and fasteners may be utilized for attachment members 82 and 82'. In one embodiment, for example, the attachment members 82 and 82' may comprise corresponding hook and loop type fasteners which may be continuously secured about the periphery of the coverlet 80 and along the inside surface 16' of the shroud 16, respectively. As such, when the attachment members 82 and 82' are disposed in cooperative engagement with one another, they form the substantially continuous seal 84 between the periphery of the coverlet 80 and the periphery of the shroud 16. Alternatively, hook and loop portions of a hook and loop type fastener may be secured in alternating and corresponding arrays about the peripheries of the coverlet 80 and the shroud 16. As before, attachment members 82 of the coverlet 80 are disposed in cooperative engagement with the corresponding attachment members 82' along the inside surface 16' of the shroud 16, a substantially continuous seal 84 is formed between the periphery of the coverlet 80 and the periphery of the shroud 16.

In one further embodiment, the attachment members 82 and 82' comprise corresponding portions of a zipper, similar to that shown at 65. As above, in this embodiment, portions of the zipper of attachment members 82 and 82' may be secured continuously about the peripheries of the coverlet 80 and the inside surface 16' of the shroud 16, or they may comprise a plurality of portions disposed about the periphery of each. Also as above, the corresponding portions of attachment members 82 and 82', i.e. corresponding portions of the zipper, are secured about the periphery of the coverlet 80 and the periphery of the inside surface 16' of the shroud 16 such that when the attachment members 82 and 82' are disposed in cooperative engagement with one another, a substantially continuous seal 84 is formed between the periphery of the coverlet 80 and the periphery of the shroud 16.

Figure 8:
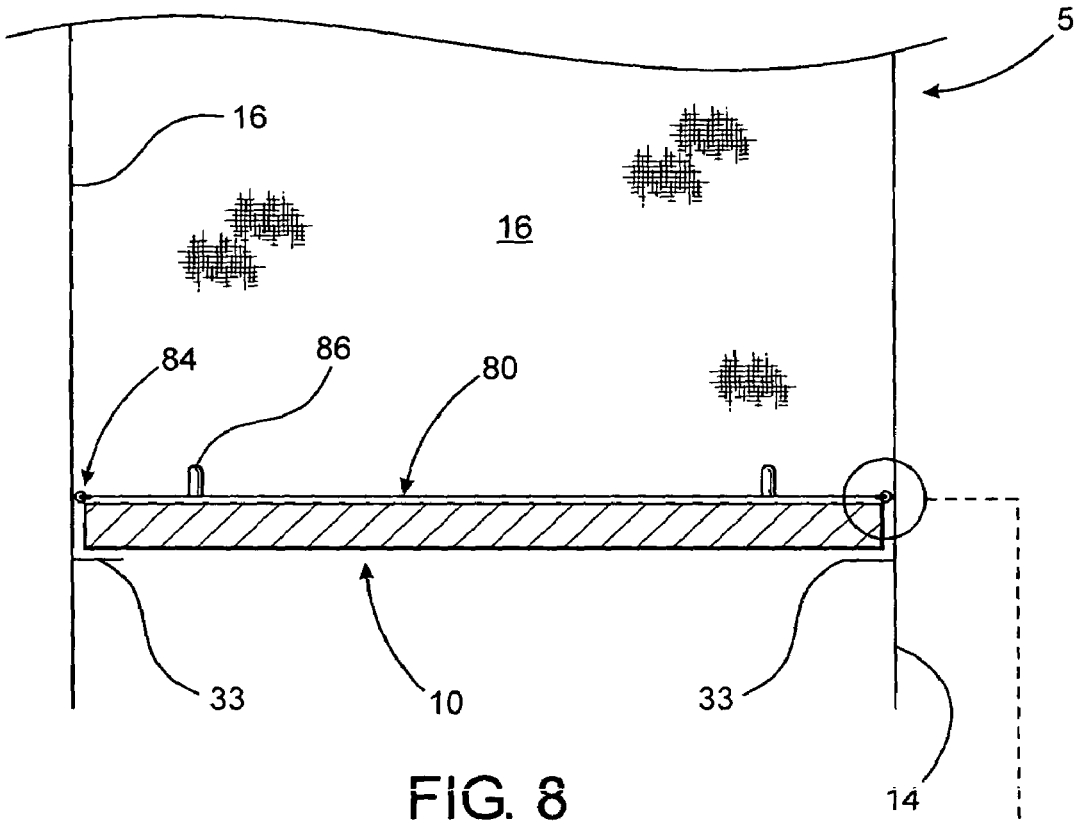
FIG. 8 is a partial cross section of the embodiment of FIG. 7 along lines 8-8 thereof.
Figure 8A:
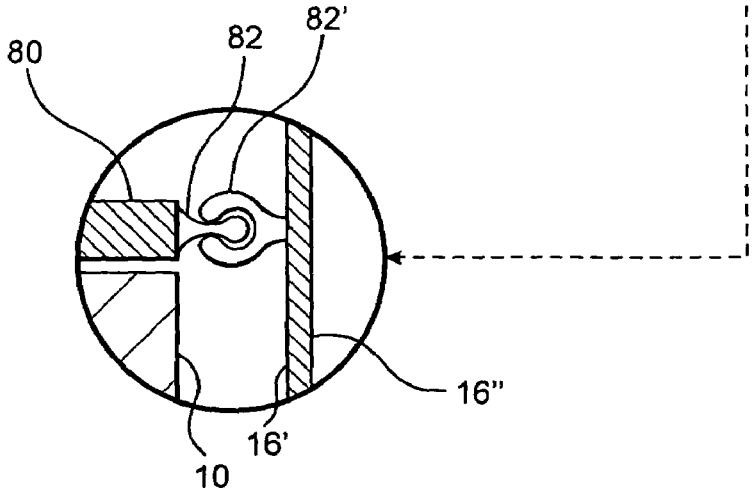
FIG. 8A is an enlarged view of attachment members of a seal as in the inset of FIG. 8.

As one example, a portion of a zipper of attachment member 82 may be disposed along each side of the coverlet 80, and additional portions of the attachment member 82 may be disposed along each of the head and foot portions of the coverlet 80. Further, in this embodiment, corresponding portions of the zipper, i.e., corresponding attachment member 82', are disposed along each side, and along each of the head and foot portions of the shroud 16, on the inside surface 16' thereof. Once again, the attachment members 82 and 82' of this example are structured to be disposed in a cooperative engagement with one another, as illustrated in FIG. 8A, thereby forming a substantially continuous seal 84 between the periphery of the coverlet 80 and the periphery of the shroud 16, along an inside surface 16' thereof, once again, further defining a "safe zone" 15 therein.

Figure 7:
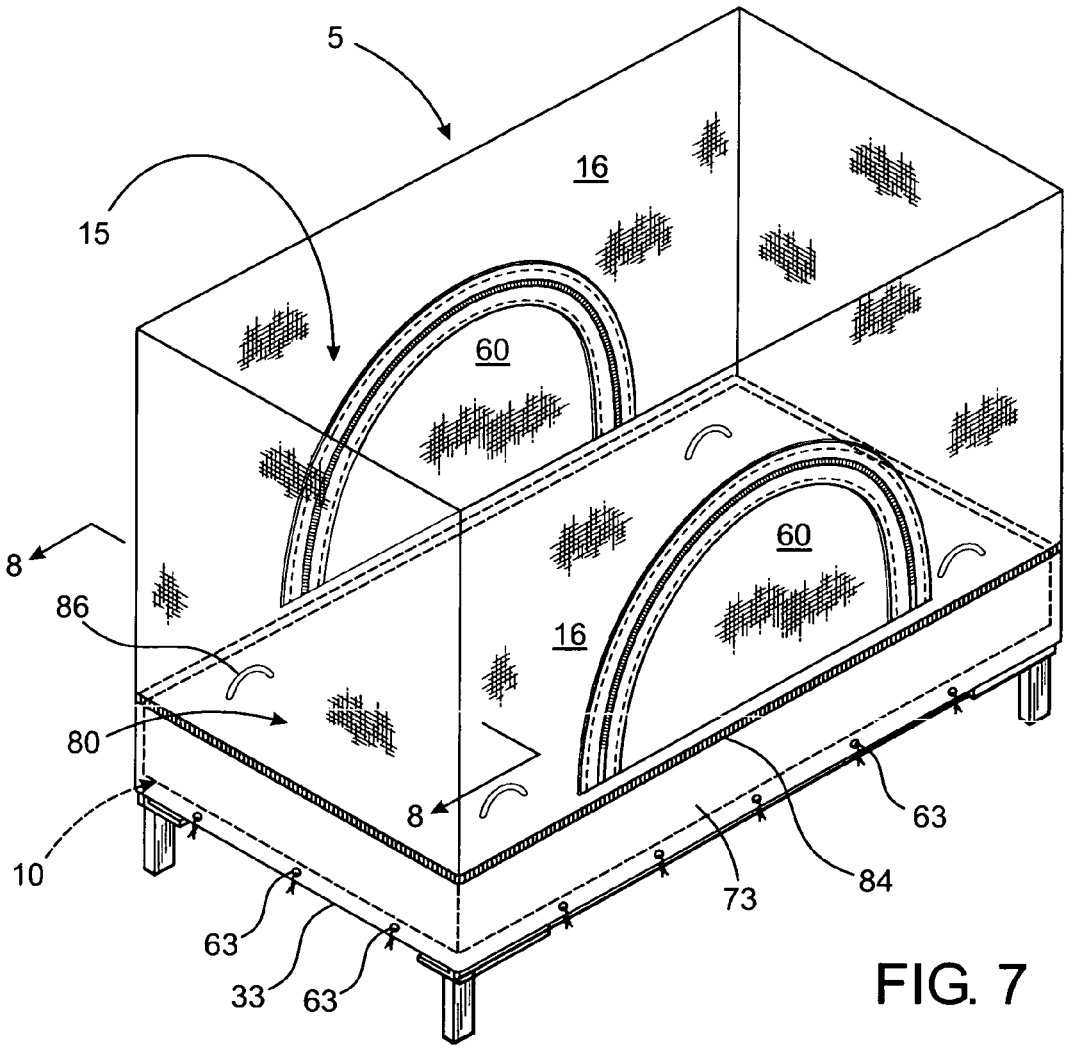
FIG. 7 is perspective view of an enclosure assembly in accordance with the present invention illustrating a coverlet.

In at least one embodiment, the coverlet 80 further comprises at least one, but preferably a plurality of grips 86 disposed thereon. The grips 86 may comprise flexible yet strong material such as, but not limited to, cotton or nylon cord, and are structured and disposed to provide a patient lying on the coverlet 80 a convenient place to grab hold of with one or both hands and/or feet in order to facilitate turning themselves over on the mattress 10, or to assist a caregiver in turning the patient from side to side as may be required for comfort, treatment, hygiene, etc. As illustrated in FIG. 7, a pair of grips 86 may be disposed at either end of the coverlet 80, and generally being disposed along the sides thereof, such that the patient has ready access from anywhere within the "safe zone" 15 to at least one of the grips 86, as may be needed. As noted above, if a blanket or cover is placed over the coverlet 80, a portion of the blanket or cover may need to be temporarily moved to one side or another to expose one or more grips 86 as may be required to assist the patient in turning over, after which time, the blanket or cover may be repositioned over the coverlet 80.

The coverlet 80 is further structured to be movable with portions of the mattress 10 which may be raised or lowered as needed for the comfort of the patient, or as necessary to effect treatment and/or recovery of the patient. As illustrated in FIG. 10, when the mattress 10 is disposed in a raised or lowered position, the coverlet 80 is structured to remain in an overlying orientation therewith and, more importantly, the attachment members 82 and 82' are structured to maintain the substantially continuous seal 84 about the periphery of the mattress 10, thereby assuring the benefits derived from the seal 84 of the present invention, as described above, may be realized for both standard and movable mattress configurations. As may be seen from the illustrative embodiment of FIG. 10, the lower skirt 73 is structured to stretch in the direction of arrows 73' to allow for the mattress 10 being raised and lowered, without affecting the integrity of the substantially continuous seal 84 around the periphery of the mattress 10 while disposed in the elevated configuration.

Referring to FIG. 1, an access opening 60 in the shroud 16 provides access into the "safe zone" 15 such as may be required to attend to a patient therein, the access opening 60 preferably being reinforced with materiel along its edges as at 64. A suitable gate or closure means 61 generally is provided to maintain the access opening 60 in a normally closed disposition, the closure means 61 comprising a zipper 65, in the illustrative embodiment of FIG. 1. As will be appreciated from FIG. 1, the ends of the zipper 65 which are used to open and close the zipper 65, are disposed on the outside of the "safe zone" 15, thereby limiting access to zipper 65 to open and close the access opening 60 to persons outside of the enclosure assembly 5, i.e., preventing access to the zipper 65 by persons within the "safe zone" 15.

Interconnecting hook and eye members 70 and 72 provide another means for securing access to the "safe zone" 15 which, as shown, comprise a plurality of spaced conventional sets of matching hook and eye members 70 and 72 provided on the reinforcement about the access opening 60 and at various other locations as may be desired. The interconnecting hook and eye members 70 and 72 are on the outside surface 16" of the shroud 16 and, thus, are not accessible to persons within the "safe zone" 15 of the enclosure assembly 5. Also as illustrated in FIG. 1, the zipper 65 may include hook and eye members to further limit accessibility of the zipper 65 for opening and closing the access opening 60 to persons located outside of the "safe zone" 15.

Referring to FIG. 6, one embodiment of connectors 36, 38, 40, and 42 for the framework 14 is illustrated in detail. In at least one embodiment, the connectors 36, 38, 40, and 42 are suitable for interconnecting corner posts 17, 18, 20 and 22, and elongated members 28, 30, 32, and 34 comprising the framework 14. Each of connectors 36, 38, 40, and 42 preferably comprises a one piece construction of molded plastic in the rigid range. More in particular, each of the connectors 36, 38, 40, and 42 includes a corner zone 50, a pair of coplanar right angularly diverging and extending tubular portions 46 and 48 and a downwardly extending portion 47. Each of the end portions of connectors 36, 38, 40, and 42, are open and are configured to mate with the ends of the corresponding posts 17, 18, 20 and 22 and elongated members 28, 30, 32 and 34, as shown in the figures. A conventional spring biased button 51 with a radially extending tip to engage a mating hole 53 in the wall of an associated member may also be provided to hold the pieces together when the framework 14 of the enclosure assembly 5 is assembled.

In use, the support floor 33 of the framework 12 of the enclosure assembly 5 receives and supports a mattress 10 of conforming shape, and the support floor 33 is mounted and tied to a conventional mattress support of a bed, or otherwise suitably secured thereto. In the illustrative embodiment of FIG. 1, the enclosure assembly 5 comprises a stand alone assembly. Once the mattress 10 is positioned on the support floor 33 within the framework 14 between and on the support floor 33 of the enclosure assembly 5, the corner posts 17, 18, 20 and 22 are connected to the framework 14 in an upstanding parallel relation to one another with one post being closely adjacent and outboard of each corner of the mattress 10. The upper end zones of the corner posts 17, 18, 20 and 22 are interconnected to elongate members 28, 30, 32 and 34, via corresponding connectors 36, 38, 40, and 42, thereby at least partially defining the framework 14, as illustrated in FIG. 3.

The shroud 16 is then interconnected to the framework 14, as illustrated in the figures, and its lower skirt 73 is secured to the framework 14, such as by laces or ties as described above, so that a patient cannot reach through or tunnel out. In the illustrative embodiment of FIG. 7, the coverlet 80 is positioned in an overlying relation to the mattress 10, and the coverlet 80 is interconnected about its periphery to the shroud 16 along the periphery of the inside surface 16' thereof, as described above. Specifically, in one embodiment, the attachment members 82 disposed about the periphery of the coverlet 80 and the corresponding attachment members 82' disposed along the periphery of the inside surface 16' of the shroud 16 are interconnected in an operatively engaging relation thereby providing a further, positive barrier within the "safe zone" 15 to prevent a patient therein from getting an arm or leg between the mattress 10 and the shroud 16, and potentially reaching a zipper 65, or a hook and eye fastener 70 and 72 from within the enclosure.

A patient in the "safe zone" 15 of the enclosure assembly 5 may be administered to as needed through the access opening 60 from the outside of the enclosure assembly 5. Eyelets 63 may be utilized for a catheter system or other small diameter tubing or wire which must pass from the outside of the enclosure assembly 5 to a patient maintained within the "safe zone" 15. In either case, the person inside the "safe zone" 15 of the enclosure assembly 5 cannot reach through the shroud 16 or between the mattress 10 and the shroud 16, as a result of the seal 84 between the shroud 16 and the coverlet 80, thereby preventing access to the exterior of the enclosure assembly 5 by persons maintained in the "safe zone" 15.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. An enclosure assembly structured to form a safe zone around an outer periphery of a mattress, said assembly comprising:

a framework having a mattress support structured to support the mattress thereon, said framework further comprising a plurality of corner posts and a plurality of spanning members disposed in an interconnected relation and at least partially defining said safe zone around the outer periphery of the mattress, a shroud supported on said framework and disposed to substantially surround the outer periphery of the mattress thereby further defining said safe zone, the shroud comprising a lower periphery, at least partially attached to the mattress support, an access opening disposed on said shroud having a closure means structured to maintain said access opening in a normally closed disposition, a coverlet having a periphery corresponding to the outer periphery of the mattress and disposed in an overlying relation thereto, and a seal disposed between said shroud and said coverlet structured to further define said safe zone.

2. The assembly as recited in claim 1 wherein said seal is disposed substantially continuously between said periphery of said coverlet and said shroud.

3. The assembly as recited in claim 1 wherein said shroud comprises an inside surface and an outside surface.

4. The assembly as recited in claim 3 wherein said shroud further comprises a periphery around said inside surface.

5. The assembly as recited in claim 4 wherein said seal is disposed substantially continuously between said periphery of said coverlet and said periphery of said inside surface of said shroud thereby further defining said safe zone within said enclosure assembly above and around the outer periphery of the mattress.

6. The assembly as recited in claim 3 wherein said closure means is structured to be accessible to a person located outside of said safe zone.

7. The assembly as recited in claim 3 wherein said closure means is structured to be inaccessible to a patient located within said safe zone.

8. An enclosure assembly structured to form a safe zone around an outer periphery of a mattress disposed on a mattress support, said assembly comprising:

a framework comprising a plurality of corner posts and a plurality of spanning members disposed in an interconnected relation so as to at least partially define said safe zone around the outer periphery of the mattress, said framework being attached to the mattress support, a shroud comprising an open net material supported on said framework substantially surrounding the outer periphery of the mattress thereby further defining said safe zone, the shroud comprising a lower periphery, at least partially attached to the mattress support, at least one access opening disposed on said shroud having a closure means structured to maintain said access opening in a normally closed disposition, said normally closed disposition at least partially defined by restricting access to said closure means to a person located outside of said safe zone, a coverlet having a periphery substantially corresponding to the outer periphery of the mattress and disposed in an overlying relation thereto, and a seal between said shroud and said periphery of said coverlet structured to further define said safe zone.

9. The assembly as recited in claim 8 wherein said closure means comprises a zipper.

10. The assembly as recited in claim 9 wherein said closure means further comprises interconnecting hook and eye members structured to restrict operation of said zipper to the person located outside of said safe zone.

11. The assembly as recited in claim 8 further comprising a plurality of access openings, each of said plurality of access openings comprising a closure means structured to maintain a corresponding one of said plurality of access openings in said normally closed disposition.

12. An enclosure assembly for a mattress, said assembly comprising:

a framework comprising a mattress support and structured to at least partially define a safe zone around an outer periphery of the mattress, a shroud comprising an open net material supported on said framework and substantially surrounding the outer periphery of the mattress thereby further defining said safe zone, the shroud further comprising a lower periphery, at least partially attached to the mattress support said shroud comprising an inside surface and an outside surface, said inside surface having a periphery disposed therearound, a plurality of access opening disposed on said shroud each having a closure means structured to maintain a corresponding one of said access openings in a normally closed disposition, said normally closed disposition being at least partially defined by restricting access to said closure means on said outside surface of said shroud to a person located outside of said safe zone, a coverlet having a periphery substantially corresponding to the outer periphery of the mattress and disposed in an overlying relation thereto, and a seal disposed substantially continuously between said periphery of said coverlet and said periphery of said inside surface of said shroud, said seal structured to restrict a patient's access to said outside surface of said shroud from within said safe zone.

13. The assembly as recited in claim 12 wherein said shroud comprises a white material of construction structured to provide a visual indication when said shroud is soiled.

14. The assembly as recited in claim 12 wherein said coverlet comprises at least one grip securely attached thereto and structured to assist the patient within safe zone in turning themselves.

15. The assembly as recited in claim 12 wherein said coverlet is structured to remain in said overlying relation to the mattress while the mattress is moved between a raised disposition and a lowered disposition.

16. The assembly as recited in claim 12 further comprising an attachment member disposed about said periphery of said coverlet and a corresponding attachment member disposed about said periphery of said inside surface of said shroud.

17. The assembly as recited in claim 16 wherein said attachment member and said corresponding attachment member are structured to be disposed in a cooperate engagement with one other thereby further defining said seal.

18. The assembly as recited in claim 17 wherein said attachment member and said corresponding attachment member collectively comprise a zipper.

19. The assembly as recited in claim 17 wherein said attachment member and said corresponding attachment member collectively comprise a hook and loop fastener.

20. The assembly as recited in claim 17 wherein said seal is structured to substantially minimize transfer of fluid from said safe zone to the mattress.

* * * * *